United States Patent [19]

Pausch

[11] Patent Number: 4,578,840

[45] Date of Patent: Apr. 1, 1986

[54] MOBILE VACUUM MACHINE

[75] Inventor: Josef Pausch, Minnetonka, Minn.

[73] Assignee: General Resource Corp., Hopkins, Minn.

[21] Appl. No.: 617,314

[22] Filed: Jun. 4, 1984

[51] Int. Cl.[4] ..... E01H 1/08

[52] U.S. Cl. ..... 15/340; 15/352; 55/356; 55/431

[58] Field of Search ..... 15/340, 352; 55/315, 55/319, 323, 324, 337, 356, 431, 459 B, 466, 467; 222/630; 406/123, 142, 143, 146

[56] References Cited

U.S. PATENT DOCUMENTS

| | | | |
|---|---|---|---|
| 2,508,297 | 5/1950 | Ruth | 55/319 |
| 3,193,867 | 7/1965 | Daneman | 15/340 |
| 3,541,631 | 11/1970 | Kluge | 15/340 |
| 3,973,935 | 8/1976 | Moore, Jr. | 15/352 |
| 3,995,754 | 12/1976 | DeKoning | 15/340 |
| 4,017,281 | 4/1977 | Johnstone | 15/352 |
| 4,028,076 | 6/1977 | Fields | 55/431 |
| 4,111,670 | 9/1978 | De Marco | 15/340 |
| 4,193,520 | 3/1980 | Duffield | 222/630 |
| 4,218,226 | 8/1980 | Boozer | 15/340 |
| 4,227,893 | 10/1980 | Shaddock | 15/340 |
| 4,411,674 | 10/1983 | Forgac | 55/431 |

FOREIGN PATENT DOCUMENTS

| | | | |
|---|---|---|---|
| 260677 | 1/1964 | Australia | 406/143 |

*Primary Examiner*—Chris K. Moore

*Attorney, Agent, or Firm*—Paul L. Sjoquist

[57] ABSTRACT

A vacuum cleaning machine for cleaning and removing industrial wastes, including hazardous waste products, mounted to the chassis of a truck having a collection tank thereon, including a flexible boom coupled to the collection tank and projecting forwardly, with a driver-actuable collection nozzle positioned in front of the truck. An air circulation system, including a blower, is used to draw material through the suction tubes into the collection tank, and a vortex separator removes particulate matter and wet residue from the suction air stream. The air circulation system includes a filter bag housing for removing further particulate matter from the suction air stream, and this is followed by a safety filter for removing the finest particulate matter from the suction air stream. The air circulation system includes a residue feedback loop for returning particulate matter from the bag filter back into the collection tank, and further includes an air conveying system for removing collected material from the tank, wherein the tank may be internally pressurized to assist in removal of the material from the tank.

3 Claims, 3 Drawing Figures

MOBILE VACUUM MACHINE

BACKGROUND OF THE INVENTION

The present invention relates to mobile vacuum pickup machines, and more particularly relates to a truck mounted machine adapted for collecting hazardous waste materials by a vacuum pickup boom which is operable by a driver from inside of the truck.

In the prior art, mobile vacuum loaders have been used in industrial applications, primarily to provide a means for collecting and storing fairly large amounts of residue, and thereafter transporting such residue to a residue dump. These devices have been mounted on truck chassis and/or trailers which are towed by trucks, and usually incorporate a movable boom or suction hose which may be manipulated by an operator in the vicinity of the truck. After the collection tank has been filled, it is typical for prior art loaders to incorporate a hydraulically-actuated dump box and tailgate so that the collected material may be dumped at a convenient site. While such devices are perfectly adequate for normal refuse pickup applications, they are not primarily adaptable for collecting hazardous waste. Hazardous waste collection frequently requires that the operator be isolated from the immediate area where the hazardous waste residue is located, and requires remote control actuation capability so that the operator can manipulate a pickup mechanism without coming into direct physical contact with the residue which is being collected. Further, hazardous waste collection and dumping usually requires the transfer of the collected residue from the collection tank into a dumping and storage area to be accomplished under isolation conditions, wherein the dumping process does not permit the escape of any of the residue into the atmosphere.

U.S. Pat. No. 4,227,893 shows a typical prior art machine. In this device, a dump truck having an enclosed box is equipped with an inlet pickup conduit for conveying wet or dry material into the collection box. An outlet from the box is connectible through a series of filters to a blower which develops the suction force necessary for collecting and conveying the necessary materials, and the blower discharges its exhaust air into the environment. The dump box is emptied by means of a hydraulic lifting mechanism which lifts the box to an inclined angle, and the material is dumped through an openable tailgate in a more or less conventional manner. Because of the construction of this machine, which is representative of the prior art, it is extremely difficult and somewhat dangerous to utilize it for the pickup of hazardous waste materials. First, the inlet conveying mechanism is adapted for manual operation by an operator, in the manner of a vacuum cleaner pickup. Second, the dumping mechanism of the machine does not provide for safe removal of the collected wastes into an enclosed space, for the waste material must be dumped at an unloading site and thereafter moved to an enclosed storage area if desired.

The present invention overcomes the foregoing disadvantages, and thereby provides a mobile pickup machine which may be operated by an operator from inside of an enclosed cab, and may be dumped into an enclosed space by means of a pressurized exhaust system.

SUMMARY OF THE INVENTION

The invention includes a pickup suction boom assembly which is attached to the front of a vehicle, and which may be manipulated by an operator from within an enclosed cab. The invention further includes an air conveying and collection system which is totally self-enclosed for ensuring that all waste material is collected into an enclosed container carried by the vehicle. The invention further includes an internal pressurized air system for cleaning residue from the respective filters contained by the vehicle and conveying such residue to the storage container. The invention further includes a pressurized air control system for exhausting the collected residue through conveying pipes or the like into an enclosed storage area without passing the collected material through the environment.

It is therefore a principal object of the present invention to provide a vehicle having a completely self-contained collection and exhaust system for picking up, transporting and dumping hazardous waste materials and the like.

It is another object of the present invention to provide a waste collection vehicle having internal and self-contained filter cleaning mechanisms.

It is another object of the present invention to provide a vehicle for picking up hazardous waste materials, wherein the pickup head is manipulable by an operator from within an enclosed cab. Further objects of the invention will become apparent by reference to the following specification and drawings, and including the claims appended hereto.

DESCRIPTION OF THE PREFERRED EMBODIMENT

Figure 1:
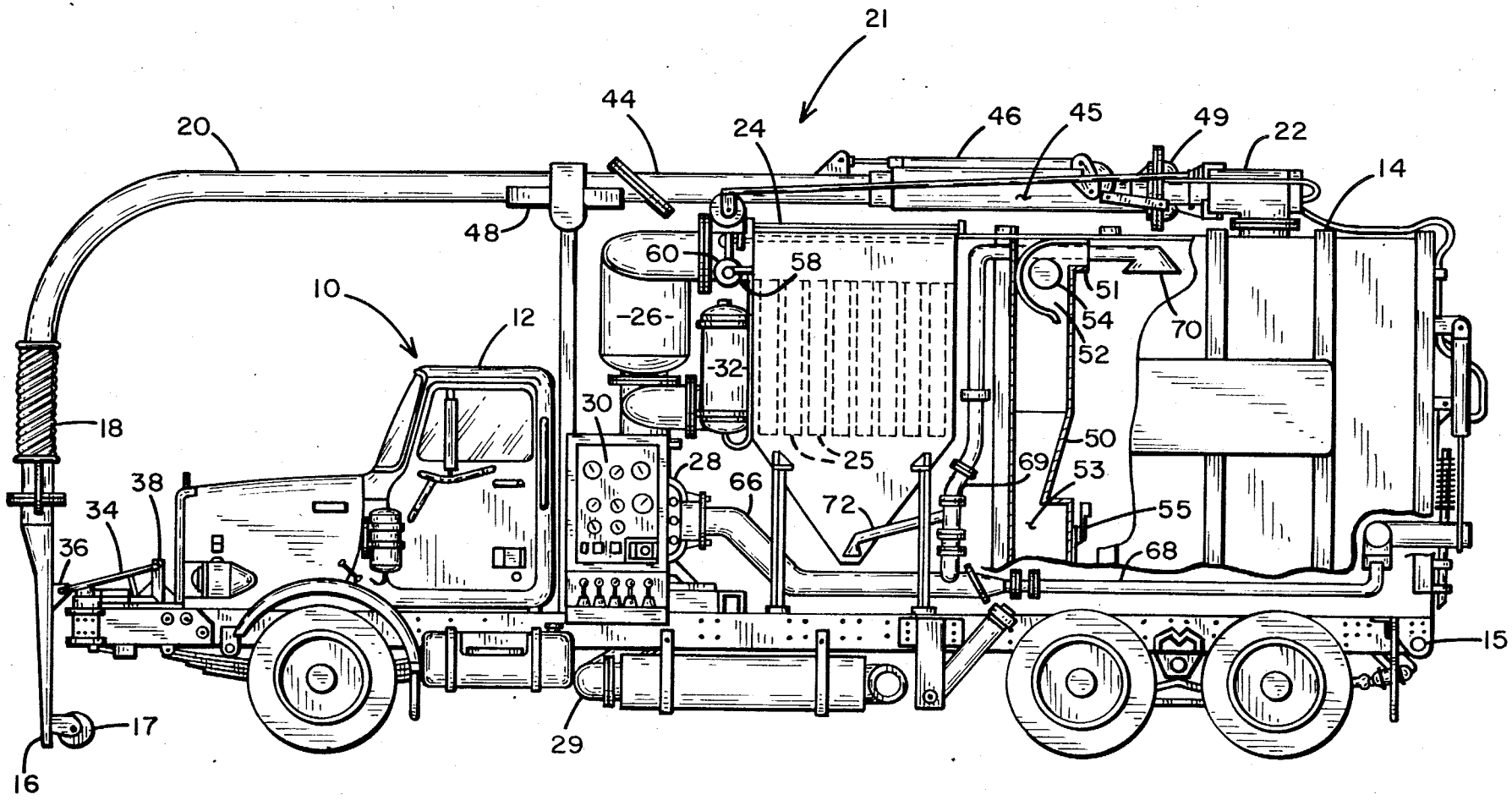
FIG. 1 shows an elevation view of the invention in partial cross section.

Referring first to FIG. 1, the invention is shown in elevation view and in partial cross section. A truck 10 of suitable size and capacity is adapted to contain all of the inventive elements disclosed herein. Truck 10 has an enclosed cab 12 for protecting a driver and operator, and the interior of cab 12 is equipped with remote control mechanisms to permit the operation of the functional parts of the invention disclosed herein. A collection tank 14 is mounted on the rear of the chassis of truck 10, and a material transfer boom 21 is attached to the top of collection tank 14 by means of a swivel coupler 22. A vacuum pickup 16 is mounted forwardly of truck 10, and is attached to a conveyor pipe 20 by means of a flexible coupler 18.

Collection tank 14 may be hydraulically tilted in a conventional manner, being rotatable about pivot 15 connected to the chassis of truck 10. A bag filter housing 24 is fixedly attached to the chassis of truck 10 forwardly of collection tank 14, and a safety filter 26 is connected to the output of filter bag housing 24. Safety filter 26 is connected into a blower 28, as is an intake filter 32. Blower 28 has an exhaust conduit 29 which is connected in a manner to be hereinafter described. A control panel 30 contains various displays and controls for operation of the equipment described herein from outside of truck 10, including the raising and lowering of tank 14 about pivot 15.

Vacuum pickup 16 has a wheel 17 mounted proximate its end, and the apparatus is adapted so that wheel 17 rolls over the ground and the open end of vacuum pickup 16 is thereby placed only a fraction of an inch above the surface of the ground. Vacuum pickup 16 is connected to a pivot arm 34 by means of a plate 36. Pivot arm 34 is connected to a remotely controllable hydraulic motor (not shown) which is coupled so as to rotate shaft 38 over a predetermined angle, thereby causing pivot arm 34 to sweep over an arcuate path at the front of truck 10. Since vacuum pickup 16 is connected to this pivot arm 34, the open end of vacuum pickup 16 may be movable over a horizontal arc proximate the entire front end of truck 10.

Conveyor pipe 20 is a forwardly extending projection of a boom 21 which includes pipes 44 and 45. Pipe 44 telescopes into pipe 45 and is extensible therefrom. The telescoping action of pipe 44 with respect to pipe 45 is accomplished by means of hydraulic cylinder 46, which is connected at its front end to pipe 44 and at its rear end to pipe 45. The assembly comprising conveyor pipe 20 and pipe 44 is supported by means of a cradle 48 which permits forward and rearward slidable motion while providing the necessary verticle supporting strength to prevent the pipes from bending. Small variations in vertical positioning of vacuum pickup 16 are accommodated by means of a flexible coupler 18 connected between conveyor pipe 20 and vacuum pickup 16. Flexible coupler 18 is extensible and retractable over limited range, thereby providing some freedom of motion for vacuum pickup 16.

Figure 3:
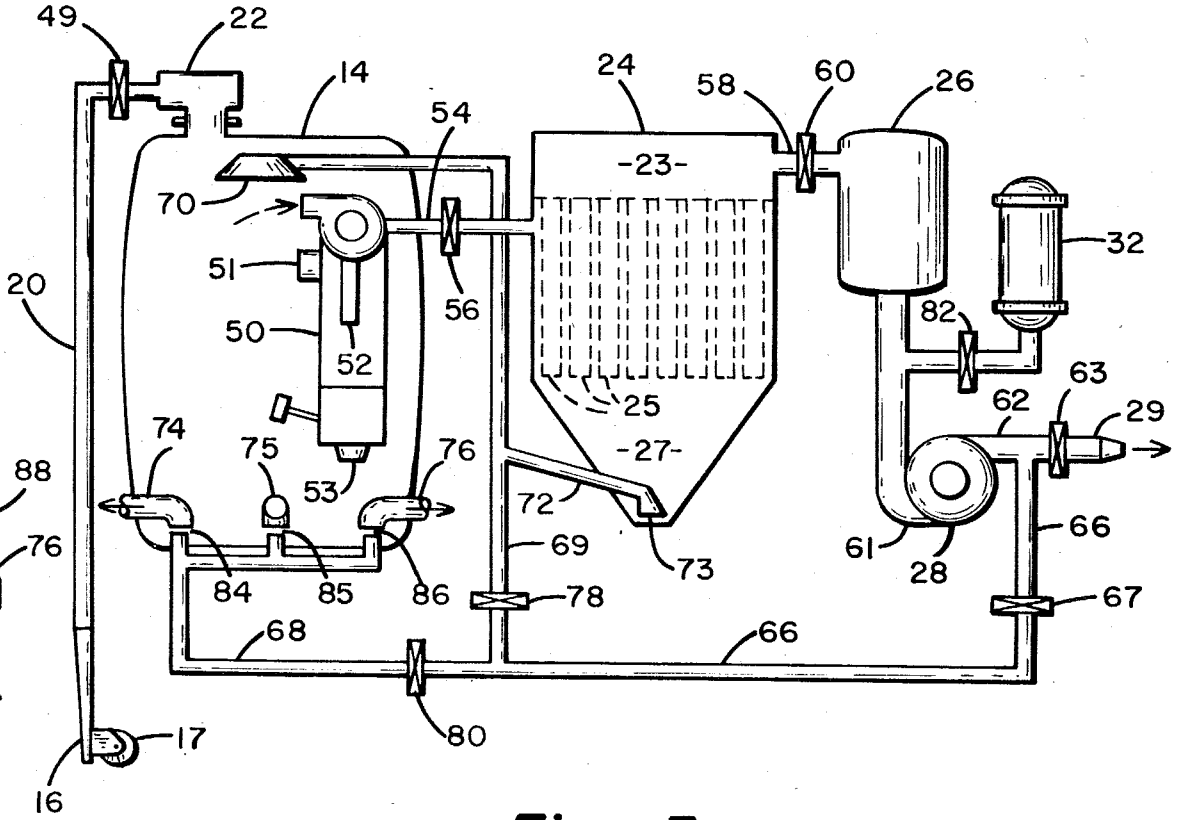
FIG. 3 shows a schematic diagram of the air conveying systems of the invention.
Figure 2:
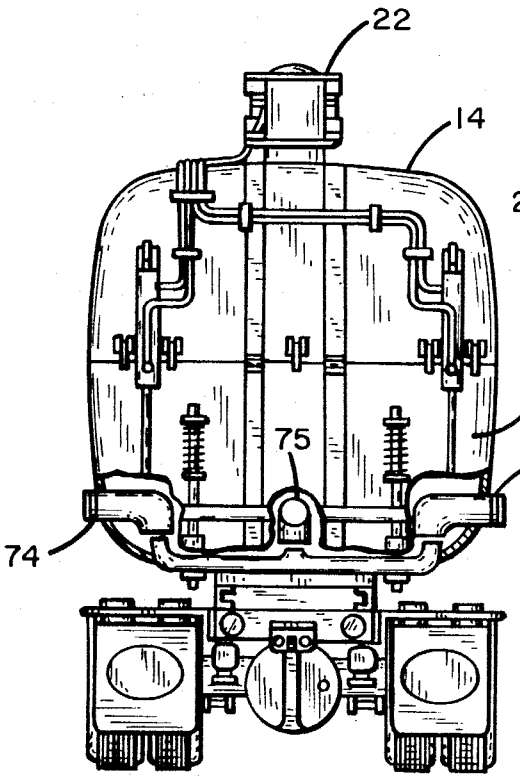
FIG. 2 shows a rear view of the invention.

The invention has multiple and varied air flow paths, all of which are operable in conjunction with blower 28, and which will be explained in further detail with reference to FIG. 1 and also with reference to the symbolic diagram of FIG. 3, wherein functionally similar components have like reference numbers. Blower 28 is preferably a high volume blower capable of developing a significant pressure, as for example a blower manufactured by the Roots Manufacturing Company, under the model designation "Whispair" which delivers 4800 cubic feet per minute (cfm) of air movement, 14.7 pounds per square inch (psi) at continuous duty. An air suction is created at vacuum pickup 16 which draws material in the vicinity of the vacuum pickup into conveyor pipe 20. A solenoid-operated valve 49 is installed in opening and closing relationship relative to conveyor pipe 20, and valve 49 may be actuated either from within cab 12 by an operator, or from control panel 30. During times when vacuum pickup 16 is in operation valve 49 is actuated to permit the free flow of air through conveyor pipe 20. Conveyed material passes through swivel coupler 22 and into the interior of collection tank 14.

A horizontal vortex separator 50 is contained within tank 14. The horizontal vortex separator 50 has an inlet 51 which is at an elevated position across the top and inside of collection tank 14, and an outlet 52 which extends across tank 14. The horizontal vortex separator 50 operates according to principals and techniques wherein material received through inlet 51 is centrifugally removed from the air flow therewith by directing the air flow about the outside of a horizontal vortex tube 54, thereby creating a vortex effect. The heavier particulate matter then drops through outlet 52 and into collection box 53. A weighted door 55 opens when tank 14 is tilted permitting material to drop into collection tank 14. Air flow through horizontal vortex separator 50 exits through vortex tube 54 into bag filter 24.

An electrically actuated solenoid valve 56 is placed in conveyor pipe 54, and is actuable by controls inside of cab 12 or on control panel 30. Valve 56 has a first closure position which blocks the air flow path through conveyor pipe 54, and a second open position which permits the free flow of air through conveyor pipe 54. Under normal vacuum pickup conditions valve 56 is in the open position.

Conveyor pipe 54 is coupled into bag filter housing 24 as an inlet, thereby conveying into filter housing 24 the finer particulate matter which may still be entrained in the air after the heavier particulate matter has been removed by vortex separator 50. Bag filter housing 24 contains a plurality of filter bags 25 which are suspended through a plurality of openings in a plate which separates filter housing 24 into an upper compartment 23 and a lower compartment 27. Filter bags 25 are constructed according to well-known techniques in the art, and are relatively porous to permit the free flow of air therethrough, while collecting on their outside surfaces any dust or particulate matter which may be entrained in the air. As accumulations of dust and dirt are collected on the exterior surfaces of filter bags 25, they eventually break off and fall to the bottom of the hopper-shaped compartment 27. Clean air passes through the filter bags 25 and into the upper compartment 23, where it is connected to an outlet pipe 58. An electricaly operated solenoid valve 60 is connected into outlet pipe 58, and valve 60 may be actuated by controls either in cab 12 or on control panel 30. Valve 60 is similar to the other valves described herein, in that it may permit the free flow of air through outlet pipe 58 or it may impede air flow therethrough.

Outlet pipe 58 is coupled into a safety filter 26, which is constructed according to any of a number of well-known techniques, and serves the purpose of removing from the air flow path any of the very fine dust particles which may still remain therein after passage through the assemblies described hereinabove. The outlet of safety filter 26 is directly coupled into blower 28 at inlet 61. Blower 28 has an outlet 62 which may be coupled in either of two directions. Under normal vacuum pickup conditions outlet 62 is coupled to an exhaust pipe 29 through a valve 63. Valve 63 operates in a manner similar to the other valves described herein, and is actuated into the open position during normal vacuum pickup conditions.

The second outlet from blower 28 may be coupled to a pressure pipe 66. Pressure pipe 66 has a valve 67 placed therein, which is normally closed when valve 63 is open. Conversely, when air flow is to be coupled into pressure pipe 66 valve 63 is closed and valve 67 is open. Pressure pipe 66 is joined to two further pipes 68, 69. Pipe 69 passes upwardly and into the interior of collection tank 14 by means of pressure outlet 70. Pipe 68 is coupled into the interior of collection tank 14, in a manner which will be hereinafter described.

A further pipe 72 is coupled into pipe 69, the remote end of pipe 72 passing through bag filter housing 24 to an open collection port placed proximate the bottom of the hopper of bag filter housing 24. The flow of air through pipe 69 causes a negative pressure to develop at the juncture of pipe 72 and 69, thereby creating a suction effect through port 73 and drawing the accumulated particulate matter at the bottom of the hopper in compartment 27 into pipe 72. This particulate matter is conveyed into pipe 69 and back into collection tank 14 by means of pressure outlet 70. At the same time, pressure outlet 70 creates a positive pressure inside of collection tank 14, the tank being constructed so as to contain this positive pressure without difficulty. In the preferred embodiment, the air flow through pressure outlet 70 creates a pressure in the range of 5–10 psi above the ambient outside air pressure. Under these circumstances valves 49 and 56 are both actuated into their respective off positions, thereby effectively pressurizing collection tank 14.

Air flow through pipe 68 is conveyed back into the interior of collection tank 14, and acts in conjunction with one or more outlet conveyors 74, 75, 76 to remove accumulations of particulate matter from the interior of collection tank 14. Outlet conveyors 74, 75, 76 may be coupled to any suitable enclosed waste collection area wherein the residue from collection tank 14 may be deposited.

An air valve 78 is located in pipe 69, and is controllable either through remote control in the truck cab or from controls on control panel 30. Air valve 78 is operable to open and close the air flow path through pipe 69, and under normal vacuum pickup operations is in a closed position, to block air flow through pipe 69.

Air valve 80 is located in pipe 68, and is operable in the same manner as air valve 78. Air valve 80 is normally in a closed position to block air flow through pipe 68.

Air valve 82 is located in the connecting pipe between intake air filter 32 and blower inlet 61, and is operable in the same manner as air valves 78 and 80. Air valve 82 is normally closed during suction intake operations, to block passage of air from intake air filter 32 into the system.

In certain circumstances it may be necessary or convenient to place the various air valves described herein in positions other than are shown in the drawings. For example, it may be sufficient for some types of operation to completely eliminate air valves 78 and 80, and utilize air valve 67 for the sole control mechanism between blower outlet 62 and pipes 68 and 69. Alternatively, it may be convenient to delete air valve 67 from the system, relying instead upon air valves 78 and 80, positioned as shown in FIG. 3. In some situations air valves 56 and 60 may be unnecessary, or it may be sufficient to include just one of them in the series air flow connection between vortex separator 50 and blower 28.

In operation, several different modes of vacuum and pressure control are possible through selective opening and closing of the respective air valves. For purposes of this description, the term "open", when referring an air valve, means that the valve is in a position to freely permit the flow of air therethrough. The term "closed", when made with reference to an air valve, means that the air valve is positioned to block air flow therethrough. Under normal vacuum pickup operational conditions, air valves 49, 56, 60, and 63 are open; air valves 67, 78, 80 and 82 are closed. This sequencing of the air valves provides for a suction air intake at vacuum pickup 16, which conveys particulate matter into tank 14, wherein the heaviest particulate matter immediately drops to the bottom of tank 14. The air flow path continues on the inside of tank 14 through inlet 51 of vortex separator 50, wherein the operation of vortex separator 50 causes much of the remaining particulate matter to become centrifugally separated out from the air flow, to drop through the bottom opening 53 of vortex separator 50 into the bottom of tank 14. The air flow path continues through outlet 52 of vortex separator 50 and into bag filter housing 24. Particulate matter remaining in entrainment in the air flow at this point accumulates over the outer surfaces of a plurality of filter bags 25, while the clean air is permitted to flow upwardly into compartment 23. Accumulated particulate matter falls from the outer surfaces of filter bags 25 into the lower compartment 27 of bag filter housing 24. The air flow path proceeds from compartment 23 into safety filter 26 for the final removal of all remaining particulate matter. Safety filter 26 may be any of a number of commercially available filters adapted for filtering very small particulate matter, such as Model 2000, manufactured by Filtra Corporation. After leaving safety filter 26, the air flow path continues into blower inlet 61 and exhausts at blower outlet 62. The exhaust air is conveyed into the atmosphere via exhaust conduit 29. Thus, in this mode of operation the suction developed by blower 28 at its inlet 61 creates a sufficient negative pressure to operate the vacuum pickup and convey the air through three separate filter stages before being exhausted into the atmosphere.

In a second unloading mode of operation air valves 67, 78, 80 and 82 are open; air valves 49, 56, 60 and 63 are closed. In this mode of operation blower 28 serves to pressurize the air flow system to cause the removal of particulate matter from inside of tank 14, as well as to cause accumulated residue in hopper 27 to be transferred into tank 14. The air flow path in this mode of operation proceeds from the atmosphere through intake air filter 32, into the inlet 61 of blower 28, and into pipe 66 where a positive pressure is developed. The air flow from pipe 66 proceeds through pipe 69 into tank 14 via pressure outlet 70, thereby developing a positive pressure inside of tank 14. The air flow also proceeds from pipe 66 into pipe 68, wherein it is coupled to one or more outlet conveyors 74, 75, 76. The outlet conveyors may be suitably coupled to a transfer pipe or hose leading to a residue storage area adapted for protective storage of hazardous wastes. The operation of this transfer mechanism may be understood with reference to FIG. 3, which shows in schematic diagram form the nature of the air flow couplings between pipe 68 and outlet conveyors 74, 75, 76. Pipe 68 is coupled into a plurality of discharge ports, each of which is associated with a respective outlet conveyor 74, 75, 76. The outlet discharge ports open into the inside of tank 14, but are separated from the inlet of the respective outlet conveyors by an air gap 84, 85, 86. The pressurized air delivered through pipe 68 passes through the respective outlet ports, through the respective air gaps, and into the outlet conveyors. A suction effect is created at each air gap 84, 85, 86, to draw particulate matter in tank 14 into the air entrainment stream, and to thereby cause the material accumulations in tank 14 to be conveyed through the outlet conveyors. The positive pressure introduced at the top of tank 14, through pressure outlet 70, assists in this removal process, by maintaining a positive pressure head at the top of the pile of accumulated residue in tank 14 to force it downwardly into flow communication with the respective outlet conveyors.

A further removal step is accomplished during the unloading operation by virtue of air flow through pipe 69. This air flow passes a juncture with pipe 72, to thereby create a negative suction force at the juncture point. This negative suction force causes accumulated particulate matter in hopper 27 to be drawn through collection port 73 and to be conveyed upwardly through pipe 69 into tank 14. The suction force developed thereby creates a relatively negative pressure in hopper 27 and a relatively higher pressure in compartment 23 within bag filter housing 24, also assisting in the reverse flow of air through the filter bags 25 to remove accumulated particulate matter which may lie on the outer surfaces of the filter bags. This accumulated matter drops to the bottom of hopper 27 and is removed as has been described hereinabove.

Various other forms and types of operation may be developed by the system herein described, through selective activation and sequencing of the air valves described herein. However, the principal modes of operation are as described; namely, a vacuum pickup operation, and an unloading and self-cleaning operation. In addition to these modes of operation the truck is adapted for raising and lowering tank 14 so that particulate matter may be removed through a rear door 18 of tank 14. This type of operation is more or less conventional and will not be further decribed herein.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A truck-mounted waste collection system adapted for vacuum pickup of materials lying on the ground surface, comprising (a) a collection tank mounted on said truck, said tank having a top inlet opening and a hinged rear cover for dumping materials accumulated therein;

(b) a vacuum pickup conduit connected to said tank inlet at one of its ends, and having a second end opening proximate the ground surface;

(c) a first outlet opening on said tank, adapted for the passage of air therethrough;

(d) filter means connected to said first outlet opening, for removing particulate matter from air passing through said first outlet opening, said filter means having a filtered air outlet;

(e) an air blower having a suction inlet and a pressure outlet, said suction inlet being connected to said filtered air outlet;

(f) a first pressure conduit coupled to said pressure outlet, said first pressure conduit having closure means therein, and having an exhaust end opening to the atmosphere;

(g) a second pressure conduit coupled to said pressure outlet, said second pressure conduit having a closure means therein and having a downstream end opening;

(h) a third pressure conduit coupled to said pressure outlet, said third pressure conduit having closure means therein and having a downstream end opening;

(i) a first pressure pipe having an end opening inside an upper region of said collection tank and having another end opening coupled to said downstream end opening of said second pressure conduit;

(j) a second pressure pipe having an end opening inside a lower region of said collection tank and having another end opening coupled to said downstream end opening of said third pressure conduit; and (k) an unloading pipe in a lower region of said collection tank, said unloading pipe having a first end opening outside said tank and a second end opening inside said tank proximate to but spaced from said second pressure pipe end opening inside said tank.

2. The apparatus of claim 1, further comprising selectively actuable closure means for closing the passage of air, interposed between said first outlet opening on said tank and said air blower suction inlet.

3. The apparatus of claim 2, further comprising means for actuating any of said closure means.

* * * * *